United States Patent [19]

Goetzl et al.

[11] 4,209,406

[45] Jun. 24, 1980

[54] X-RAY DIAGNOSTIC GENERATOR

[75] Inventors: Horst Goetzl, Erlangen; Manfred Rattner, Erlangen-Buckenhof, both of Fed. Rep. of Germany

[73] Assignee: Siemens Aktiengesellschaft, Berlin & Munich, Fed. Rep. of Germany

[21] Appl. No.: 941,319

[22] Filed: Sep. 11, 1978

[30] Foreign Application Priority Data

Nov. 11, 1977 [DE] Fed. Rep. of Germany ..... 2750563

[51] Int. Cl.[2] ..... H05G 1/00

[52] U.S. Cl. ..... 250/402; 250/408

[58] Field of Search ..... 250/402, 408, 409, 417, 250/418, 421, 403, 404, 405

[56] References Cited

U.S. PATENT DOCUMENTS

| | | | |
|---|---|---|---|
| 2,168,801 | 8/1939 | Lee et al. | 250/418 |
| 3,878,394 | 4/1975 | Golden | 250/402 |
| 4,117,334 | 9/1978 | Strauts | 250/421 |

FOREIGN PATENT DOCUMENTS 1029948 4/1960 Fed. Rep. of Germany .

*Primary Examiner*—Craig E. Church
*Assistant Examiner*—Thomas P. O'Hare
*Attorney, Agent, or Firm*—Hill, Van Santen, Steadman, Chiara & Simpson

[57] ABSTRACT

A half-wave rectifier is connected between the cathode-side end of the secondary winding of the high voltage transformer and the x-ray tube anode. Between the anode and the anode-side end of the high voltage secondary winding, a high voltage capacitor is connected, which is capable of storing a portion of the energy necessary in order to feed the x-ray tube during one mains half wave. The rectifier is polarized such that the capacitor is charged during those particular secondary half waves in which current does not flow through the x-ray tube.

1 Claim, 2 Drawing Figures

X-RAY DIAGNOSTIC GENERATOR

BACKGROUND OF THE INVENTION

The invention relates to an x-ray diagnostic generator comprising a high voltage transformer, and a high voltage half-wave rectifier between one end of the secondary winding of the high voltage transformer and the anode of the x-ray tube.

X-ray diagnostic generators of this type are e.g. utilized for the purpose of preparing dental x-ray photographs. In these instances, all generators are housed, as a rule, in an oil-filled tank.

In the known x-ray diagnostic generators of the type initially cited, it is disadvantageous that the high voltage transformer is loaded only during the mains half wave of one polarity, and that it can therefore reach saturation. In addition, during those particular mains half waves in the course of which the x-ray tube blocks, a comparatively high no-load voltage is connected to the x-ray tube. The secondary circuit of the high voltage generator, accordingly, must be dimensioned for a comparatively high peak voltage if corresponding means are not primarily introduced.

SUMMARY OF THE INVENTION

The object underlying the invention consists in producing an x-ray diagnostic generator of the type initially cited which is improved compared with the state of the art with regard to the load of the high voltage transformer and the peak voltage in the secondary circuit.

This object is achieved in accordance with the invention by virtue of the fact that the rectifier is connected to the cathode-side end of the secondary winding of the high voltage transformer, that a high voltage capacitor is connected between the anode of the x-ray tube and the anode-side end of the secondary winding of the high voltage transformer, and that the rectifier is polarized in such a manner that, during those particular secondary half waves in which current does not flow through the x-ray tube, the capacitor is charged. In the inventive x-ray diagnostic generator, during one load half wave, the x-ray tube high voltage is composed of the secondary voltage of the high voltage transformer and the voltage of the capacitor. It is thus approximately twice as great as the secondary voltage of the high voltage transformer. The x-ray tube is virtually short-circuited during those half waves in which current does not flow through it. Thus, a pulsating d.c. voltage is connected to said x-ray tube. Faulty half waves with a comparatively high no-load peak voltage do not occur. The high voltage transformer is loaded during the positive as well as during the negative mains half waves, such that no asymmetrical conditions in the magnetization occur. It need be dimensioned only for approximately half the peak high voltage desired at the x-ray tube. A weight-economizing thereby results as compared with the instance in which said high voltage transformer supplies the full high voltage for the x-ray tube.

An expedient further development of the x-ray diagnostic generator in accordance with the invention, wherein the secondary winding of the filament transformer of the x-ray tube is a component part of the high voltage transformer consists in that the cathode-side end of the high voltage secondary winding and the one end of the secondary winding of the filament transformer are connected by a resistance, and that the high voltage rectifier is connected, at the connection point of the resistance to the high voltage secondary winding, whereas a control grid of the x-ray tube is connected to a tap of the high voltage secondary winding. In this further development, a stabilization of the x-ray tube current takes place via the control grid due to the voltage drop at the resistance between the filament and high voltage secondary windings of the transformer. The charging of the capacitor thus takes place bypassing this resistance, such that said charging proceeds within the shortest time; i.e., during one mains half wave.

According to an expedient embodiment of the inventive x-ray diagnostic generator, a plastic (or synthetic material) housing manifesting two chambers can be present, in the one chamber of which the x-ray tube is arranged and in the other chamber of which the high voltage capacitor is arranged. The high voltage transformer can thus be rigidly connected with this housing and arranged, together with the housing, in an oil-filled tank.

The invention shall be explained in greater detail in the following on the basis of a sample embodiment illustrated in the accompanying sheet of drawings; and other objects, features, and advantages will be apparent from this detailed disclosure and from the appended claims.

DETAILED DESCRIPTION

Figure 1:
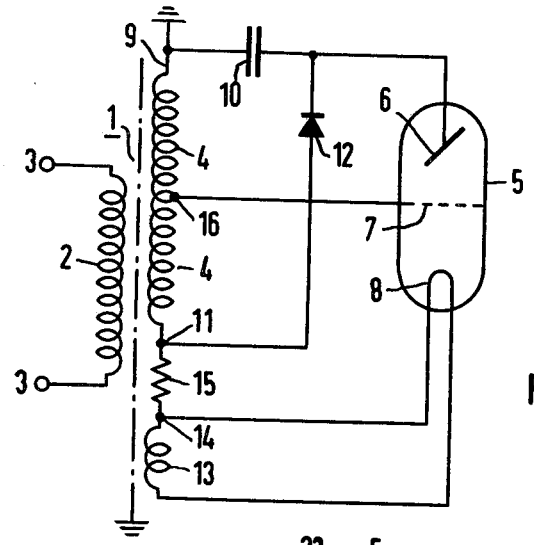
FIG. 1 illustrates a circuit diagram of an x-ray diagnostic generator according to the invention.

In FIG. 1, a high voltage transformer 1 is illustrated whose primary winding 2 is connectable via terminals 3 to the mains. The secondary winding 4 of the high voltage transformer 1 feeds an x-ray tube 5 which has an anode 6, a control grid 7, and a cathode 8. Anode 6 is connected to the anode-side end 9 of the secondary winding 4 via a capacitor 10. The cathode-side end 11 of the secondary winding 4 is connected to the anode 6 via a high voltage half-wave rectifier 12. The heating of the cathode 8 proceeds from a filament transformer secondary winding 13, which is a component part of the high voltage transformer 1. The primary winding 2 thus is simultaneously also the primary winding of the filament transformer. The cathode-side end 11 of the secondary winding 4 and end 14 of filament winding 13 are interconnected by a resistance 15. The control grid 7 is connected to a tap 16 of secondary winding 4.

In order to explain the method of operation of the described x-ray diagnostic generator, let it be initially assumed that a positive potential is connected to the winding end 11 of the secondary winding 4, and a negative potential is connected to the winding end 9. The high voltage half wave rectifier 12 is, in this instance, transmissive, and capacitor 10 is rapidly charged to a peak voltage; namely, in the course of one secondary half wave, said peak voltage being approximately equal to the peak voltage of the secondary half wave. The anode-cathode path of the x-ray tube 5 is virtually short-circuited by the high voltage half-wave rectifier 12 such that no current flows through x-ray tube 5.

If the polarity of the secondary voltage alternates, then a negative potential is connected to the winding end 11, and a positive potential is connected to the winding end 9. In this case, the voltage source formed by secondary winding 4 and the voltage source formed by capacitor 10 are connected in series, such that a peak voltage is connected between anode 6 and cathode 8 which is approximately twice as great as the peak voltage at the secondary winding 4. The high voltage transformer 1 thus need be dimensioned only for half the peak voltage of the high voltage at x-ray tube 5, and accordingly, it can manifest a comparatively small weight. The x-ray tube 5 is subjected to a voltage only during each second mains half wave. During those particular mains half waves in which current virtually does not flow through said x-ray tube 5, it is virtually short-circuited by the high voltage half-wave rectifier 12; thus the tube 5 is not loaded by comparatively high voltage faulty half-waves in no-load operation. Current flows through high voltage transformer 1 during the positive and the negative mains half waves. In the one instance, capacitor 10 is charged, whereas, in the other instance, current flows through x-ray tube 5. Thus, it is symmetrically loaded and not premagnetized.

The voltage drop at resistance 15 is a function of the intensity of the current in x-ray tube 5. Accordingly, the negative bias potential at control grid 7 is dependent upon the intensity of this current. The greater the current, the greater the negative bias potential. A current stabilization—i.e., a long term maintenance of constant x-ray tube current—is thereby achieved.

Because the high voltage half-wave rectifier 12 is connected to circuit point 11 and not to circuit point 14, the time constant for the charging of capacitor 10 is not affected in an undesired manner by resistance 15. This time constant is, accordingly, very small.

In a practical example, it has been shown that, for a load-peak voltage at x-ray tube 5 of 70 kV and, correspondingly, a secondary load voltage of 35 kV at the secondary winding 4, a capacitor of six nanofarads (6 nF) is suitable. The resistance value of resistance 15 can e.g. amount to forty kilohms (40 kOhm).

Figure 2:
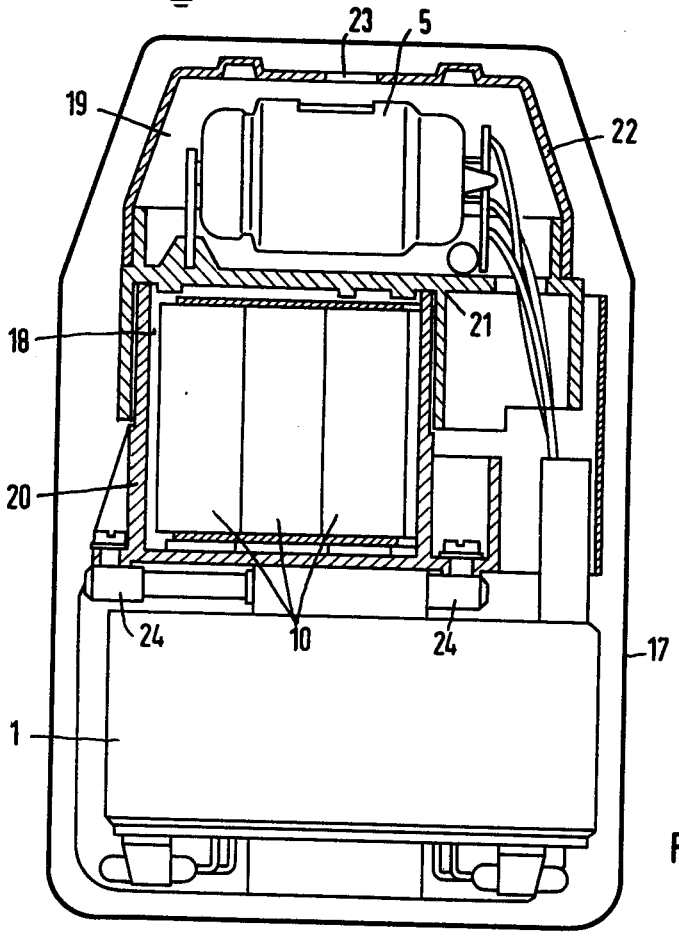
FIG. 2 illustrates a section through an x-ray diagnostic generator in accordance with the invention.

FIG. 2 illustrates the arrangement of the individual parts of the circuit according to FIG. 1 in an oil-filled tank 17. In tank 17, a plastic housing is present manifesting two chambers 18 and 19, and which consists of housing parts 20, 21 and 22. The housing part 22 has a window 23 for the passage of the x-radiation of x-ray tube 5. The x-ray tube 5 is arranged in chamber 19 and the capacitor 10, consisting of several individual capacitors, is arranged in chamber 18. The high voltage transformer 1 is connected with the housing part 20 by means of a screw connection 24.

It will be apparent that many modifications and variations may be effected without departing from the scope of the novel concepts and teachings of the present invention.

We claim as our invention:

1. An x-ray diagnostic generator comprising a high voltage transformer and a high voltage half-wave rectifier between one end of the secondary winding of the high voltage transformer and the anode of the x-ray tube, characterized in that the rectifier (12) is connected to the cathode-side end (11) of the secondary winding (4) of the high voltage transformer (1), that a high voltage capacitor (10) is connected between the anode (6) of the x-ray tube (5) and the anode-side end (9) of the secondary winding (4) of the high voltage transformer (1), and that the rectifier (12) is polarized such that the capacitor (10) is charged during those particular secondary waves in which current does not flow through the x-ray tube (5), wherein the filament winding for the x-ray tube is a component part of the high voltage transformer, characterized in that the resistance (15) is connected between the cathode-side end (11) of the high voltage secondary winding (4) and one end (14) of the filament winding (13) at the secondary side, and that the high voltage rectifier (12) is connected with the high voltage secondary winding (4) at the connection point (11) of the resistance (15), a control grid (7) of the x-ray tube (5) being connected with a tap (16) of the high voltage secondary winding (4).

* * * * *